US006390037B2

(12) United States Patent
Di Lieto et al.

(10) Patent No.: US 6,390,037 B2
(45) Date of Patent: May 21, 2002

(54) METHOD FOR REGULATION OF CURRENTS DURING PHASES OF STOPPAGE IN ELECTROMAGNETIC ACTUATORS, FOR ACTUATION OF INTAKE AND EXHAUST VALVES IN INTERNAL-COMBUSTION ENGINES

(75) Inventors: Nicola Di Lieto, Salerno; Gilberto Burgio, Ferrara; Roberto Flora, Forli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/815,369

(22) Filed: Mar. 22, 2001

(30) Foreign Application Priority Data

Mar. 24, 2000 (IT) ..... BO00A0165

(51) Int. Cl.[7] ..... F01L 9/04
(52) U.S. Cl. ..... 123/90.11; 361/154
(58) Field of Search ..... 123/90.11; 361/154

(56) References Cited

U.S. PATENT DOCUMENTS

| | | | | |
|---|---|---|---|---|
| 5,671,705 A | * | 9/1997 | Matsumoto et al. | 123/90.11 |
| 5,742,467 A | | 4/1998 | Schmitz | 361/154 |
| 5,775,276 A | * | 7/1998 | Yanai et al. | 123/90.11 |
| 5,782,211 A | * | 7/1998 | Kamimaru | 123/90.11 |
| 5,964,192 A | * | 10/1999 | Ishii | 123/90.11 |
| 6,279,523 B1 | * | 8/2001 | Iida et al. | 123/90.11 |

FOREIGN PATENT DOCUMENTS

| | | |
|---|---|---|
| CA | 1276679 | 11/1990 |
| DE | 44 34 684 | 4/1996 |
| DE | 197 39 840 | 3/1999 |
| DE | 198 06 619 | 8/1999 |
| DE | 198 18 126 | 10/1999 |
| EP | 0 225 444 | 6/1987 |
| JP | 09-195736 | 7/1997 |
| JP | 11-324742 | 11/1999 |

* cited by examiner

*Primary Examiner*—Weilun Lo
(74) *Attorney, Agent, or Firm*—Baker & Daniels

(57) ABSTRACT

Method for regulation of currents during phases of stoppage in electromagnetic actuators, for actuation of intake and exhaust valves in internal-combustion engines, in which an actuator is connected to a respective intake or exhaust valve which has a position, and includes a mobile unit, which is actuated magnetically in order to control the movement of the valve, a sensor which supplies a position signal which is representative of a present position of the mobile unit, and a first and a second electromagnet, which are disposed on opposite sides of the mobile unit, and receive respectively a first and a second current; the mobile unit being disposed in a position of stoppage during phases of stoppage. The method includes the phases of: setting at least one current out of the first and the second currents to an initial maintenance value, when the valve is in a position of stoppage; checking that the valve remains in a position of stoppage for a pre-determined interval of time; and decrementing the current, if the valve has remained in a position of stoppage for the pre-determined interval of time.

8 Claims, 3 Drawing Sheets

METHOD FOR REGULATION OF CURRENTS DURING PHASES OF STOPPAGE IN ELECTROMAGNETIC ACTUATORS, FOR ACTUATION OF INTAKE AND EXHAUST VALVES IN INTERNAL-COMBUSTION ENGINES

The present invention relates to a method for regulation of currents during phases of stoppage, in electromagnetic actuators, for actuation of intake and exhaust valves in internal-combustion engines.

BACKGROUND OF THE INVENTION

As is known, propulsion units are currently at an experimental stage, in which the actuation of the intake and exhaust valves is controlled by means of use of actuators of an electromagnetic type, which replace the purely mechanical distribution systems (cam shafts).

In particular, these actuators comprise a pair of electromagnets disposed on opposite sides of a mobile ferromagnetic element, which is connected to a respective intake or exhaust valve, and is maintained in a position of rest by means of resilient elements (for example a spring and/or a torsion bar). The mobile ferromagnetic element is actuated by means of application of a force generated by the electromagnets, such that it is made to abut alternately one or the other of the electromagnets itself, so as to move the corresponding valve between the positions of closure and maximum opening, according to required times and paths. By this means, it is possible to actuate the valves according to optimum raising conditions in all operative conditions of the engine, thus improving substantially the overall performance.

In addition, during phases of stoppage, it is necessary to retain the valves alternately in the position of closure or of maximum opening. For this purpose, it is known to supply to the electromagnets maintenance currents with a predetermined intensity, which is lower than the intensity of the currents distributed during the phases of movement of the valves (phases of flight), but is sufficient to prevent any disturbances, such as unforeseen variations of pressure, dispersion current or drift caused by wear of the components, from giving rise to displacements of the valves themselves from the required position.

However, by this means, there is a high absorption of electrical power which does not make it possible to obtain optimum performance levels. In fact, the maintenance currents must guarantee that the force exerted on the mobile element by the electromagnets is greater than the forces of disturbance which can intervene. Since the intensity of these currents is set during calibration, and cannot be modified except by means of intervention by specialised personnel, it is necessary to provide a margin of safety. Consequently, the maintenance currents distributed are far greater than those which are actually necessary, moment by moment, in order to maintain the valves in the respective required positions. Since, in addition, the duration of the phases of stoppage is far greater than the duration of the phases of flight, in which the valves are displaced between the respective positions of closure and maximum opening, the overall performance of the engine is disadvantageously reduced.

SUMMARY OF THE INVENTION

The object of the present invention is to provide a method for regulation of currents during phases of stoppage, which makes it possible to overcome the disadvantages described, and which, in particular, makes if possible to reduce the overall consumption of electrical power.

According to the present invention, a method is provided for regulation of currents during phases of stoppage in electromagnetic actuators for actuation of intake and exhaust valves in internal combustion engines, in which an actuator is connected to a respective intake or exhaust valve which has a position, and comprises a mobile unit which is actuated magnetically in order to control the movement of the said valve, a sensor which supplies a position signal representative of a present position of the said mobile unit, and a first and a second electromagnet, which are disposed on opposite sides of the said mobile unit, and receive respectively a first and a second current; the said mobile unit being disposed in a position of stoppage during phases of stoppage; the said position of stoppage corresponding alternately to a first position of end of travel, in which the said mobile unit abuts the said first electromagnet, and to a second position of end of travel, in which the said mobile unit is disposed such as to abut the said second electromagnet; the method being characterised in that it comprises the phases of:

a) setting at least one current out of the said first and second currents to an initial maintenance value, when the said valve is in the said position of stoppage;

b) checking that the said valve remains in the said position of stoppage for a pre-determined interval of time; and c) decrementing the said at least one current, if the said valve has remained in the said position of stoppage for the said pre-determined interval of time.

BRIEF DESCRIPTION OF THE DRAWINGS

In order to assist understanding of the invention, an embodiment is now described, purely by way of non-limiting example and with reference to the attached drawings, in which.

DETAILED DESCRIPTION OF THE INVENTION

Figure 1A:
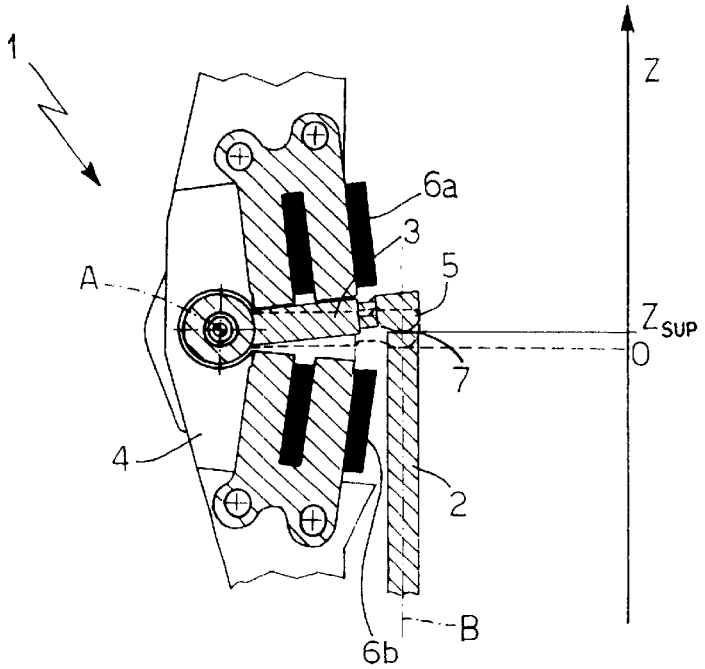
FIGS. 1*a* and 1*b* are lateral elevated views, partially in cross-section, of an electromagnetic actuator and of the corresponding intake or exhaust valve, respectively in a first and a second position of end of travel.
Figure 1B:
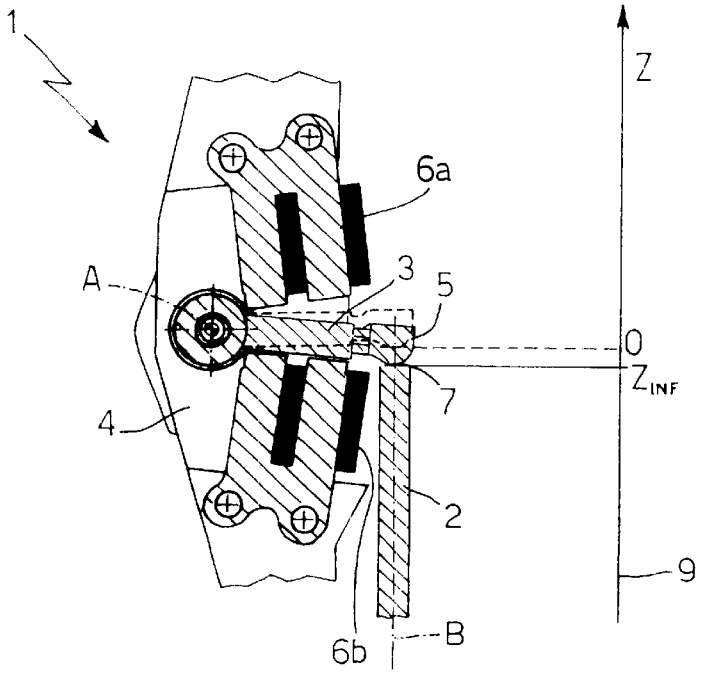

With reference to FIGS. 1*a* and 1*b*, an electromagnetic actuator 1 is connected to an intake or exhaust valve 2 of an internal-combustion engine, which for the sake of convenience is not shown. The actuator 1 comprises a small oscillating arm 3 made of ferromagnetic material, which has a first end pivoted on a fixed support 4, such as to be able to oscillate around an axis A of rotation, which is horizontal and is perpendicular to a longitudinal axis B of the valve 2. In addition, a second end 5 of the small oscillating arm 3 co-operates such as to abut an upper end of the valve 2, so as to impart to the latter reciprocal motion in a direction parallel to the longitudinal axis B.

The actuator 1 comprises an electromagnet 6*a* for closure, and an electromagnet 6*b* for opening, which are disposed on opposite sides of the body of the small oscillating arm 3, such as to be able to act by command, in sequence or simultaneously, to exert a net force on the small oscillating arm 3, in order to make it rotate around the axis A of rotation.

In addition, a first and a second resilient element, for example a spring and a torsion bar, which for the sake of convenience are not shown, act such as to maintain the small oscillating arm 3 in a position of rest, in which it is equidistant from the polar heads of the electromagnets respectively for closure 6*a* and opening 6*b*.

FIGS. 1*a* and 1*b* also show a reference axis 9, which is directed such as to be parallel to the longitudinal axis B of the valve 2, which contains a tip which is representative of the position of the oscillating arm 3 (for example the tip of a lower edge 7 of the second end 2, which at all times is at the longitudinal axis B). Hereinafter. "present position Z" will mean reference to this co-ordinate. Since the end 5 normally abuts the upper end of the valve 2, the present position Z is also representative of the position of the valve 2 itself.

In particular, in FIG. 1*a,* the small oscillating arm 3 is illustrated in a first position of end of travel, i.e. in a position of closure, to which there corresponds a value of position of closure $Z_{SUP}$ on the reference axis 9.

On the other hand, in FIG. 1*b,* the small oscillating arm is represented in a second position of end of travel, i.e. in a position of maximum opening, in which it abuts the polar head of the electromagnet 6*b* for opening. A value of maximum opening $Z_{INF}$ on the reference axis 9 corresponds to this position of maximum opening.

In addition, both in FIG. 1*a* and FIG. 1*b,* the small oscillating arm 3 is shown, drawn in a broken line, in the position of rest, in which the origin of the reference axis 9 is assumed.

Figure 2:
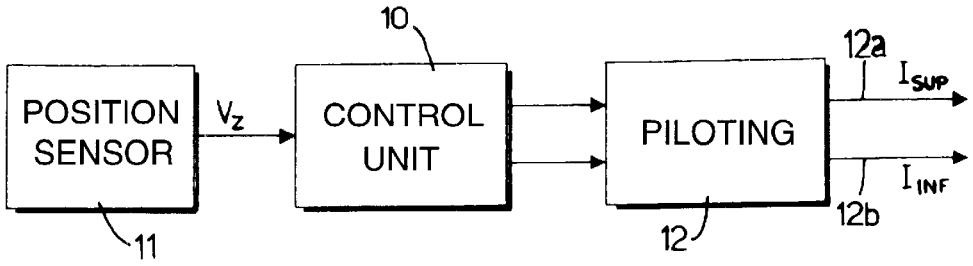
FIG. 2 is a simplified block diagram relating to the method for control according to the present invention.

With reference to FIG. 2, a control system for the actuator 1, which implements the present method, comprises a control unit 10, which has an input connected to a position sensor 11, which supplies a position signal $V_Z$, which is representative of the present position Z of the valve 2, and an output connected to a piloting device 12. The latter has a first and a second output 11*a,* 11*b,* which are connected respectively to the upper electromagnet 6*a* and the lower electromagnet 6*b*.

The control unit 10 is designed for execution of many functions, including functions of control of the actuators, for actuation of the intake and exhaust valves 2. In particular, for each actuator 1 present, the control unit calculates and supplies to the piloting device 12 respective instantaneous values i of an upper current $I_{SUP}$ and a current $I_{INF}$, which must be supplied respectively to the upper 6*a* and lower 6*b* electromagnets, in order to actuate the valve 2 according to pre-determined movement profiles.

During phases of stoppage, the valve 2 is retained in a position of stoppage, which corresponds alternately to the position of closure $Z_{SUP}$ or maximum opening $Z_{INF}$. In the first case (position of stoppage corresponding to the position of closure $Z_{SUP}$), the force exerted on the small oscillating arm 3 is generated by means of the upper electromagnet 6*a* (active), whereas the lower electromagnet 6*b* is de-activated. On the other hand, in the second case (position of stoppage corresponding to the position of maximum opening $Z_{INF}$), the force exerted on the small oscillating arm 3 is generated by means of the lower electromagnet 6*b* (active), whereas the upper electromagnet 6*a* is de-activated. For the sake of convenience, reference will be made firstly to a phase of stoppage in which the position of stoppage corresponds to the position of closure $Z_{SUP}$, i.e. in which the valve 2 is maintained in the position of closure $Z_{SUP}$ by means of the upper electromagnet 6*a*.

Figure 3A:
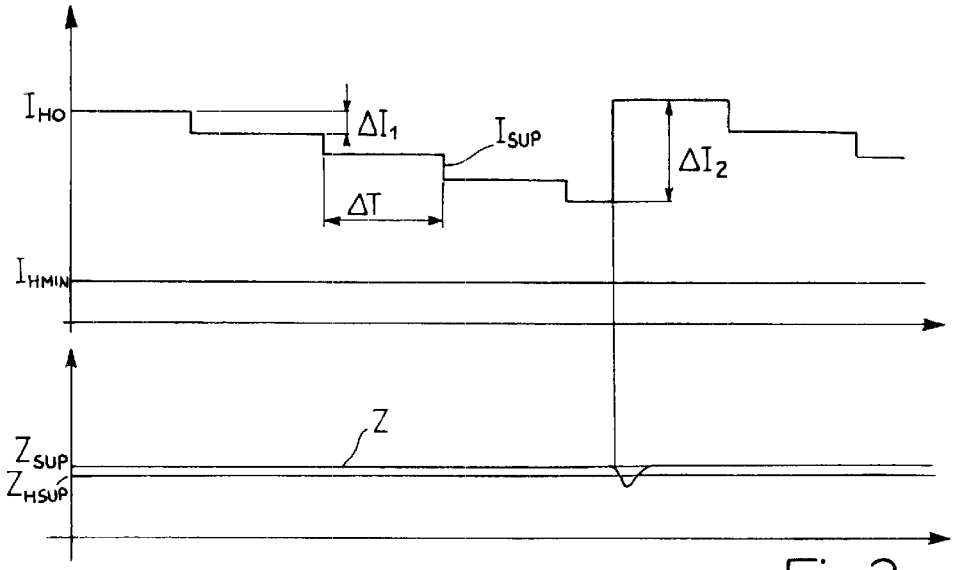
FIGS. 3*a* and 3*b* show graphs relating to the development of quantities according to the present method.

As shown in FIG. 3*a,* at the input in the phase of stoppage, the upper current $I_{SUP}$ which is supplied to the upper electromagnet 6*a* is initially set to an initial maintenance value $I_{HO}$, which is stored by the control unit 10.

If, after an interval of time ΔT with a pre-determined duration, which, for example, is between 5 ms and 10 ms, the valve 2 has remained stably in the position of closure $Z_{SUP}$, the upper current $I_{SUP}$ is decremented by a decrement step $\Delta I_1$, with a value which is pre-determined, and is preferably between 5 mA and 10 mA. Subsequently, for as long as the valve 2 is maintained the position of closure $Z_{SUP}$, the value of the upper current $I_{SUP}$ is decreased once more, by a quantity which is equivalent to the decrement step $\Delta I_1$ at the end of each interval of time ΔT.

If, on the other hand, displacement of the valve 2 from the position of closure $Z_{SUP}$ is detected, the value of the upper current $I_{SUP}$ is increased by an increment step $\Delta I_2$, which is greater than the decrement step $\Delta I_1$, and, for example, is equivalent to $5*\Delta I_1$. Subsequently, the upper current $I_{SUP}$ starts to be decremented once more by the decrement step $\Delta I_1$ at each interval of time ΔT, until a further displacement of the valve 2 takes place.

In order to detect in good time the displacements of the valve 2, it is verified that the present position Z of the valve 2 itself is maintained higher than a pre-determined upper threshold $Z_{HSUP}$, which is close to, and slightly lower than, the position of closure $Z_{SUP}$. In addition, the control unit 10 determines an estimate of a speed of the valve 2, and verifies that, in absolute value, this estimate is lower than a pre-determined threshold speed. By this means, the control unit 10 intervenes, in order to return the valve 2 to the required position, as soon as it begins to move. Consequently, during the phases of stoppage, the valve 2 can undergo only minimal movements, which do not affect the correct operation of the engine.

In addition, if the upper current $I_{SUP}$ reaches a minimum maintenance value $I_{HMIN}$, it is not decremented further.

Figure 4:
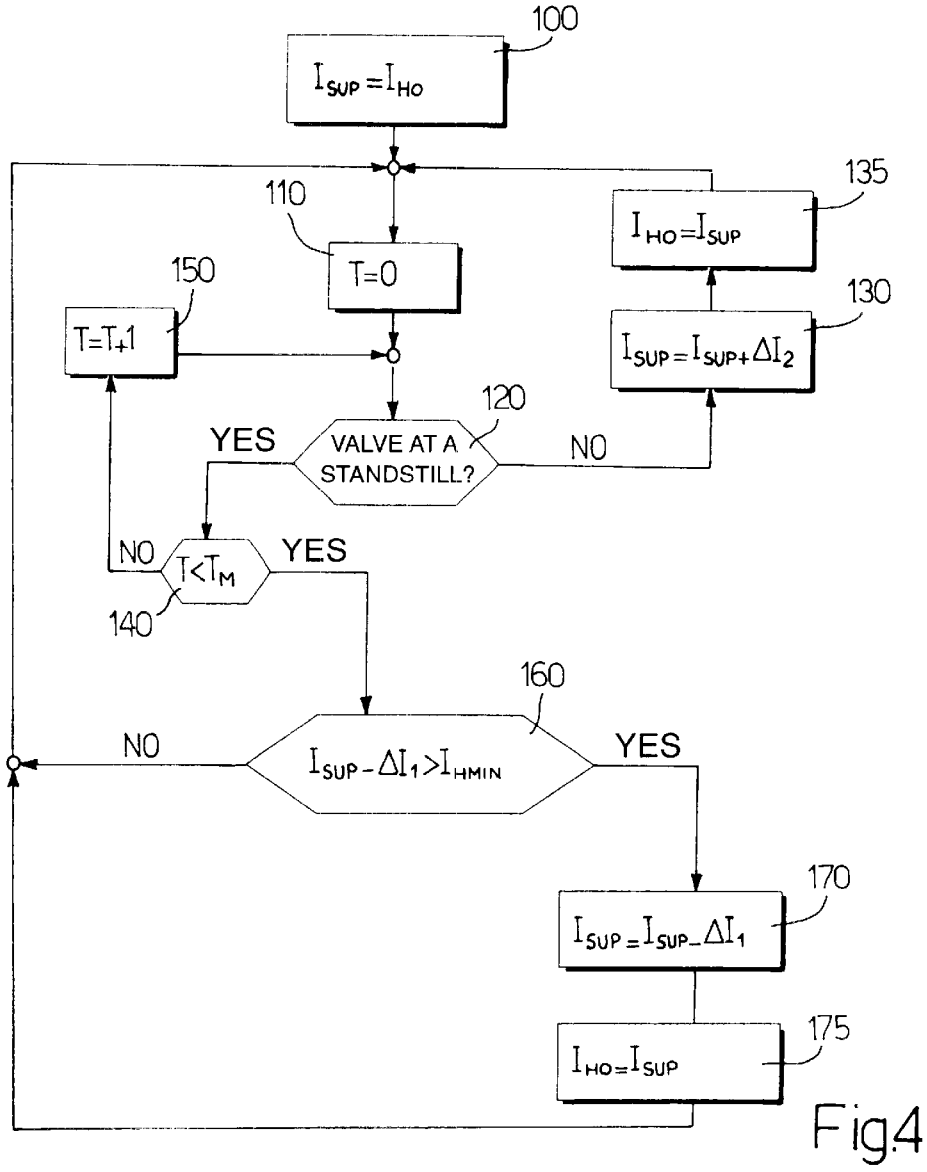
FIG. 4 is a flow chart relating to the present method.

As shown in greater detail in FIG. 4, at the start of a phase of maintenance, in which the valve 2 is in the position of closure, the upper current $I_{SUP}$ is set to the initial maintenance value $I_{HO}$ stored (block 100). A timer T is then initialised (block 110), and a test is carried out in order to verify that the valve 2 is kept at a standstill (block 120), in particular by checking whether the present position Z is greater than the upper threshold $Z_{HSUP}$, and the estimate of the speed is lower, in absolute value, than the threshold speed.

If a displacement is detected (NO output from block 120), the upper current $I_{SUP}$ is incremented by the increment step $\Delta I_2$ (block 130), then, the initial maintenance value $I_{HO}$ is set such as to be equivalent to the upper current $I_{SUP}$, and is stored (block 135). Subsequently, the timer T is initialised once more (block 110).

Otherwise (YES output from block 120), it is checked whether the counter T has reached a maximum value $T_M$ (block 140), i.e. whether an interval of time ΔT has elapsed since the last modification of the value of the upper current $I_{SUP}$.

If the condition has not occurred (NO output from block 140), the timer T is incremented by one unit (block 150), then the test is carried out once more in order to verify that the valve 2 is at a standstill (block 120).

Otherwise (YES output from block 140), it is checked whether it is possible to decrement the upper current $I_{SUP}$, without reducing it to below the minimum maintenance value $I_{HMIN}$ (block 160), i.e. whether the condition $$I_{SUP}-\Delta I_1>I_{HMIN}$$ has occurred.

If this is the case (YES output from block 160), the upper current $I_{SUP}$ is decremented by the decrement step $\Delta I_1$ (block 170), and, after updating and storage of the initial maintenance value $I_{HO}$ (which is set such as to be equivalent to the upper current $I_{SUP}$, block 135), there is initialisation once more of the timer T (block 110); otherwise (NO output from block 160), the decrement is not carried out, and there is return directly to initialisation of the timer T (block 110).

The foregoing can also easily be extended to regulation of the lower current $I_{INF}$ distributed to the lower electromagnet 6*b* during the phases of stoppage in which the stoppage position corresponds to the position of maximum opening, i.e. in which the valve 2 is in the position of maximum opening $Z_{INF}$.

In particular, the lower current $I_{INF}$ is set to the initial value $I_{HO}$, and is then decremented by the decrement step $\Delta I_1$, whenever a time interval elapses in which there is no detection of displacements of the valve 2 from the position of maximum opening $Z_{INF}$.

Figure 3B:
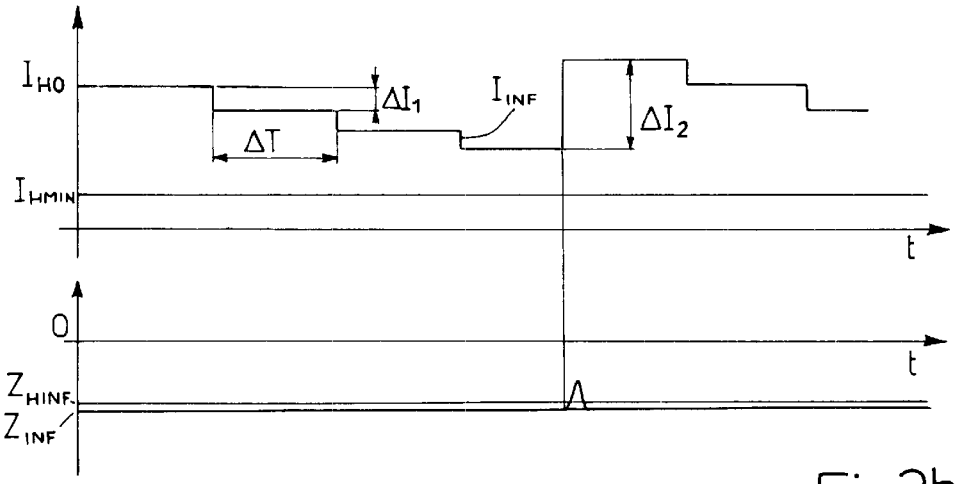

Displacement of the valve 2 from the position of maximum opening $Z_{INF}$ is detected when the present position Z of the valve 2 itself exceeds in absolute value a predetermined lower threshold $Z_{HINF}$, which is close to, and slightly higher than, the position of maximum opening $Z_{INF}$ (FIG. 3*b*), or when the estimate of the speed of the valve 2 is greater, in absolute value, than the threshold of speed.

In addition, if the lower current $I_{INF}$ reaches the minimum maintenance value $I_{HMIN}$, it is not decremented further.

The foregoing description makes apparent the advantages which are provided by the method for regulation according to the present invention.

Firstly, it is possible to obtain a considerable reduction in the currents distributed to the electromagnets during the phases of stoppage. In fact, since these currents are regulated during operation of the engine, and represent the minimum currents which are actually required in order to maintain the valves in their respective required positions, a priori it is not necessary to set safety margins. Also, since the duration of the phases of maintenance is far greater than the duration of the phases of flight, the overall consumption is reduced substantially, and the efficiency of the engine is consequently increased.

A further advantage is provided by the fact that the currents distributed during the phases of maintenance can be increased, if it is necessary to counteract disturbances of a particularly high level. This constitutes an element of increased safety compared with the conventional systems, in which the intensity of the currents distributed during the phases of maintenance can not be varied.

The method according to the present invention can advantageously be used for example in the case of the method for control of electromagnetic actuators described in patent application number B099A000689 of Dec. 17, 1999, filed in the name of the applicant.

This patent application relates to the control of an electromagnetic actuator substantially of the type of the actuator 1 described in FIGS. 1*a* and 1*b*, to which reference will continue to be made. According to the method described in the aforementioned application, the control unit 10 in FIG. 2 can alternatively select a first control method, defined hereinafter as "closed-loop control", and a second control method, defined hereinafter as "open-loop control". In particular, the closed-loop control is active during the phases of flight, and makes it possible to displace the valve 2 between the positions of closure and maximum opening, quickly, and in accordance with required movement profiles. During the phases of stoppage on the other hand, the open-loop control is active, which uses the method for regulation according to the present invention.

According to the aforementioned patent application, during the phases of flight, a check with feedback is carried out on the actual position Z and an actual speed V of the valve 2, using as a checking variable the net force applied by means of the electromagnets for closure 6*a* and opening 6*b*, to the small oscillating arm 3 which actuates the valve 2 itself. For this purpose, by means of a model which is based on a dynamic system, there is calculation of an objective force $F_o$ to be exerted on the small oscillating arm, in accordance with a real position, a real speed, a reference position and a reference speed of the valve. In particular, the dynamic system is described by means of the following matrix equation:

$$\begin{bmatrix} \dot{Z} \\ \dot{V} \end{bmatrix} = \begin{bmatrix} 0 & 1 \\ K/M & B/M \end{bmatrix} \begin{bmatrix} Z \\ V \end{bmatrix} + \begin{bmatrix} 0 \\ 1/M \end{bmatrix} F \tag{2}$$

in which $\dot{Z}$ and $\dot{V}$ are the temporal derivatives respectively of the real position Z and the real speed V; F is the net force exerted on the small oscillating arm 3; K is a resilient constant, B is a viscous constant, and M is a total equivalent mass. In particular, the net force F and the real position Z represent respectively an input and an output of the dynamic system.

In addition, the objective force value $F_o$ is calculated according to the equation:

$$F_o=(N_1Z_R+N_2V_R)-(K_1Z+K_2V) \tag{3}$$

in which $N_1$, $N_2$, $K_1$ and $K_2$ are gains which can be calculated by applying well-known robust control techniques to the dynamic system represented by the equation (2).

Subsequently, there is calculation of the current values to be allocated to the electromagnet for closure 6*a* and opening 6*b*, in order for the net force exerted on the small oscillating arm 3 to have a value which is equivalent to the objective force value $F_o$.

During the phases of stoppage, the open-loop control is active, which uses the method for regulation according to the present invention, as previously stated. Consequently, the current distributed (i.e. the upper current $I_{SUP}$, when the valve 2 is in the position of closure $Z_{SUP}$, and the lower current $I_{INF}$, when the valve 2 is in the position of maximum opening $Z_{INF}$) is gradually decremented, until displacement of the valve 2 from the required position is detected. In this case, the control unit 10 selects simultaneously the closed-loop control, which quickly restores the valve 2 to the required position, so as not to affect the operation of the engine. As soon as the valve 2 reaches the required position, the control unit 10 restores the open-loop control, in order to minimise the current distributed. This therefore provides developments of the current distributed and of the present position Z of the valve 2, of the type shown in FIG. 2 (in the case of a phase of stoppage of the valve 2 in the position of closure).

The advantage is therefore apparent of combining the method for closed-loop control, which is particularly efficient during the phases of flight, with the method according to the present invention, which makes it possible to reduce the consumption during the phases of stoppage. In fact, by this means, it is possible to obtain a substantial increase in the overall performance of the engine.

Finally, it is apparent that modifications and variants can be made to the method described, without departing from the context of the present invention.

What is claimed is:

1. Method for regulation of currents during phases of stoppage in electromagnetic actuators, for actuation of intake and exhaust valves in internal-combustion engines, in which an actuator (1) is connected to a respective intake or exhaust valve (2) which has a position (Z), and includes a mobile unit (3), which is actuated magnetically in order to control the movement of the said valve (2), a sensor (12) which supplies a position signal ($V_Z$) which is representative of a present position (Z) of the said mobile unit (3), and a first and a second electromagnet (6*a*,6*b*), which are disposed on opposite sides of the said mobile unit (3), and receive respectively a first and a second current ($I_{SUP}$, $I_{INF}$); the said mobile unit (3) being disposed in a position of stoppage ($Z_{SUP}$, $Z_{INF}$) during phases of stoppage; the said position of stoppage ($Z_{SUP}$, $Z_{INF}$) corresponding alternately to a first position of end of travel ($Z_{SUP}$), in which the said mobile unit (3) abuts the said first electromagnet (6*a*), and to a second position of end of travel ($Z_{INF}$), in which the said mobile unit (3) is disposed such as to abut the said second electromagnet (6*b*); the method being characterised in that it comprises the phases of:

a) setting (100) at least one current ($I_{SUP}$, $I_{INF}$) out of the said first and the second currents ($I_{SUP}$, $I_{INF}$) to an initial maintenance value ($I_{HO}$), when the said valve (2) is in the said position of stoppage ($Z_{SUP}$, $Z_{INF}$);

b) checking (120) that the said valve remains in the said position of stoppage ($Z_{SUP}$, $Z_{INF}$) for a pre-determined interval of time ($\Delta T$); and c) decrementing (170) the said at least one current ($I_{SUP}$, $I_{INF}$), if the said valve has remained in the said position of stoppage ($Z_{SUP}$, $Z_{INF}$) for the said pre-determined interval of time ($\Delta T$).

2. Method according to claim 1, characterised in that it additionally comprises the phase of:

d) incrementing (130) the said at least one current ($I_{SUP}$, $I_{INF}$), if the said valve (2) has not remained in the said position of stoppage ($Z_{SUP}$, $Z_{INF}$) for the said pre-determined interval of time ($\Delta T$).

3. Method according to claim 1, characterised in that the said phase b) of checking (120) that the said valve remains in the said position of stoppage ($Z_{SUP}$, $Z_{INF}$), comprises the phase of:

b1) verifying that the said present position (Z) is higher, in absolute value, than a pre-determined threshold ($Z_{HSUP}$, $Z_{HINF}$).

4. Method according to claim 3, characterised in that the said phase b) of checking (120) that the said valve remains in the said position of stoppage ($Z_{SUP}$, $Z_{INF}$), additionally comprises the phase of:

b2) estimating a speed of the said valve (2); and b3) verifying that the said speed of the said valve (2) is lower than a threshold speed.

5. Method according to claim 1, characterised in that the said phase c) of decrementing (170) the said at least one current ($I_{SUP}$, $I_{INF}$), is carried out if the said at least one current ($I_{SUP}$, $I_{INF}$) is higher than a minimum maintenance current ($I_{HMIN}$).

6. Method according to claim 1, characterised in that the said phase c) of decrementing (170) the said at least one current ($I_{SUP}$, $I_{INF}$), is obtained by decrementing the said at least one current ($I_{SUP}$, $I_{INF}$) by a decrement step ($\Delta I_1$), and in that the said step d) of incrementing (130) the said at least one current ($I_{SUP}$, $I_{INF}$) is obtained by incrementing the said at least one current ($I_{SUP}$, $I_{INF}$) by an increment step ($\Delta I_2$); the said increment step ($\Delta I_2$) being greater than the said decrement step ($\Delta I_1$).

7. Method according to claim 1, characterised in that it additionally comprises the steps of:

e) updating the said initial maintenance value ($I_{HO}$); and f) storing the said initial maintenance value ($I_{HO}$) (135, 175).

8. Method according to claim 7, characterised in that the said phase e) of updating the said initial maintenance value ($I_{HO}$) is obtained by setting the said initial maintenance value ($I_{HO}$) such that it is equivalent to the said at least one current ($I_{SUP}$, $I_{INF}$).

* * * * *